United States Patent [19]

Richter

[11] Patent Number: 4,974,822

[45] Date of Patent: Dec. 4, 1990

[54] SHEET PRODUCT FOLDING AND FOLDED PRODUCT TRANSPORT AND HANDLING APPARATUS, PARTICULARLY PRINTED PRODUCTS DERIVED FROM A PRINTING MACHINE

[75] Inventor: Johannes Richter, Augsburg, Fed. Rep. of Germany

[73] Assignee: Man Roland Druckmaschinen AG, Offenbach-am-Main, Fed. Rep. of Germany

[21] Appl. No.: 350,549

[22] Filed: May 11, 1989

[30] Foreign Application Priority Data

May 17, 1988 [DE] Fed. Rep. of Germany ..... 3816690

[51] Int. Cl.[5] ..... B42C 1/10

[52] U.S. Cl. ..... 270/48; 270/47; 270/21.1; 270/50

[58] Field of Search ..... 270/4, 5, 6, 7, 8, 9, 270/12, 13, 14, 15, 16, 21.1, 32, 41–44, 47–51, 60

[56] References Cited

U.S. PATENT DOCUMENTS

| | | | |
|---|---|---|---|
| 615,770 | 12/1898 | Wendt . | |
| 3,727,908 | 4/1973 | Whitesell | 270/43 |
| 4,190,242 | 2/1980 | Bolza-Schuneman | 270/42 |
| 4,190,243 | 2/1980 | Michalik | 270/42 |
| 4,211,396 | 7/1980 | Michalik | 270/47 |
| 4,564,470 | 1/1986 | Schmitt | 270/21.1 |

FOREIGN PATENT DOCUMENTS

| | | | |
|---|---|---|---|
| 0068341 | 1/1983 | European Pat. Off. . | |
| 2025347 | 6/1971 | Fed. Rep. of Germany . | |
| 2512368 | 9/1976 | Fed. Rep. of Germany . | |
| 3124639 | 1/1983 | Fed. Rep. of Germany . | |
| 63-106276 | 5/1988 | Japan | 270/21.1 |

*Primary Examiner*—Edward K. Look
*Assistant Examiner*—Therese M. Newholm
*Attorney, Agent, or Firm*—Frishauf, Holtz, Goodman & Woodward

[57] ABSTRACT

To provide a compact, readily adjustable system which provides two longitudinal folds on a printed web, a combination transfer and collection cylinder has product retention means (11, 35) thereon, such as grippers (11) or puncture needles (35); selectively operable lift-off fingers (14, 14') remove the printed products from the cylinder (10) and feed them, superimposed, between belts (7, 17), the belts being guided by drive and guide rollers (18, 19, 20, 21). A pair of drive and guide rollers is constructed to form a perforating blade-perforating groove roller combination (22, 23) to provide perforations in a plurality of superposed first folded products for subsequent delivery to a second folding apparatus (29, 30). To retain an adjusted position between the perforating line formed by the perforating blade-groove roller combination and the second folding apparatus, and in order to place the second fold on the perforating line, an auxiliary frame unit (35) is selectively shiftable with respect to the frame (33) of the apparatus which also retains said cylinder (10) to provide for conjoint shifting of the drive roller and transport belt system (18–23) and the second folding apparatus (29, 30).

12 Claims, 3 Drawing Sheets

SHEET PRODUCT FOLDING AND FOLDED PRODUCT TRANSPORT AND HANDLING APPARATUS, PARTICULARLY PRINTED PRODUCTS DERIVED FROM A PRINTING MACHINE

The present invention relates to apparatus for handling and transporting folded products, and especially to paper handling apparatus, in which printed webs are derived from a printing machine, the webs are then folded, cross-cut into folded sheets, if desired assembled into a plurality of superposed folded sheets, and then folded once more longitudinally. In the description and claims that follow, reference will be made to "paper handling" and "paper sheets" or "webs"; it is to be understood that this is for purposes of illustration only and not intended in a limiting sense.

BACKGROUND

Folding apparatus to fold paper which has been printed on is described for example, in German Patent No. 25 12 368, in which folded products are collected on a collection or assembly cylinder, to be transferred to a transfer cylinder for subsequent transfer to a belt system. The belt system then transports the folded, and collected sheets to a second longitudinal folding apparatus. A perforating groove ring is integrated with the transfer cylinder. A perforating blade cylinder, having one or more perforating blades with projecting pins or teeth, is operatively associated with the transfer cylinder. The toothed perforating blade, in combination with the perforating groove on the transfer cylinder, forms perforations on all the assembled, superimposed folded products at the level of the second longitudinal fold, in order to provide for a temporary association of the respective products, so that they are connected or fixed together and prevented from sliding or slipping with respect to each other. The perforation is carried out when the folded products are bent or curved, since they are located on the transfer cylinder. The folded products, after transfer to the belt system, are then stretched and the change in orientation of the folded products, from the bent position on the cylinder to a flat position on the transport system, at times loosens the interengagement of the sheets due to the perforation. To prevent such loosening, the radius of the perforating groove ring, as well as the transfer cylinder, must be large.

The perforating apparatus, the collection cylinder and the transfer cylinder are usually retained in a frame portion of the machine. The longitudinal folding apparatus is a separate unit, located in a second separate machine frame. The position of the second longitudinal fold should occur at the center of the folded products. To align the position of the second fold with the perforations, which are also to be at the center, requires adjustment of the position of the second longitudinal fold independently of any position of the perforating blade and the perforating groove ring. The perforating blade and groove ring can also be adjusted, so that alignment requires matching the adjustment or adjusted position of the second longitudinal folding apparatus with respect to the adjusted position of the perforating blade and its associated perforating groove ring.

THE INVENTION

It is an object to improve the handling of paper products which are to be folded, perforated, and again folded, by providing an apparatus which is more compact than prior apparatus, does not require rollers or cylinders of substantial diameter, and additionally, preferably, also permits placement of all structural elements required for a second longitudinal fold in alignment with perforations which previously have been placed on the folded products in a single operating step.

Briefly, a combination transfer and collection cylinder is provided which has means to retain the preliminarily folded products thereon, for example grippers or puncturing needles. A separate lift-off mechanism is provided, so that when, selectively, a plurality of products are collected on the transfer and collection cylinder, superimposed above each other and driven by the product retaining means, the then selected number of folded products is delivered to a product transport system. The product transport system is a belt system; in accordance with a feature of the invention, one of the roller pairs which guide the belts is a combination perforating blade cylinder-perforating groove cylinder, so that the products are perforated as they are being transported from the transfer and collection cylinder to a second longitudinal folding apparatus.

In accordance with a preferred feature of the invention, the first and second longitudinal folding apparatuses are relatively movable. The second longitudinal folding apparatus is located on an auxiliary frame which also retains the rollers which guide and drive the transport belt system as well the perforating blade and perforating groove cylinders. The perforating blade and groove cylinders can be roller structures of a diameter which is small with respect to the diameter of the transfer and collection cylinder, for example comparable to drive or guide and deflection rollers for the transport belt system.

The arrangement has the advantage that the folded products, having received their first fold and placed on the transfer and collection cylinder, are directly transferred to the transport belt system so that a separate transfer cylinder can be eliminated. This substantially facilitates the structure of the folding apparatus and renders it much more compact, particularly since the collection cylinder need have a diameter only sufficient to accomodate the size of the expected products to be handled thereby, and need not be designed to facilitate the transition of perforated products from curve to flat state. Perforation is carried out while the products are being transported between the transport belts and while they are all already flat. Shifting the perforation step to a position in which the folded products are already flat, permits use of blade, and perforating groove rollers on an auxiliary frame which also retains the second folding apparatus ensures alignment of the second folding apparatus with the perforations placed in the folded products by the perforating blade-groove roller combination. Any adjustment of the second fold position with respect to the first fold, therefore, can be carried out during operation of the apparatus without, at the same time, requiring independent adjustment of the perforating apparatus.

DRAWINGS

DETAILED DESCRIPTION

Figure 1:
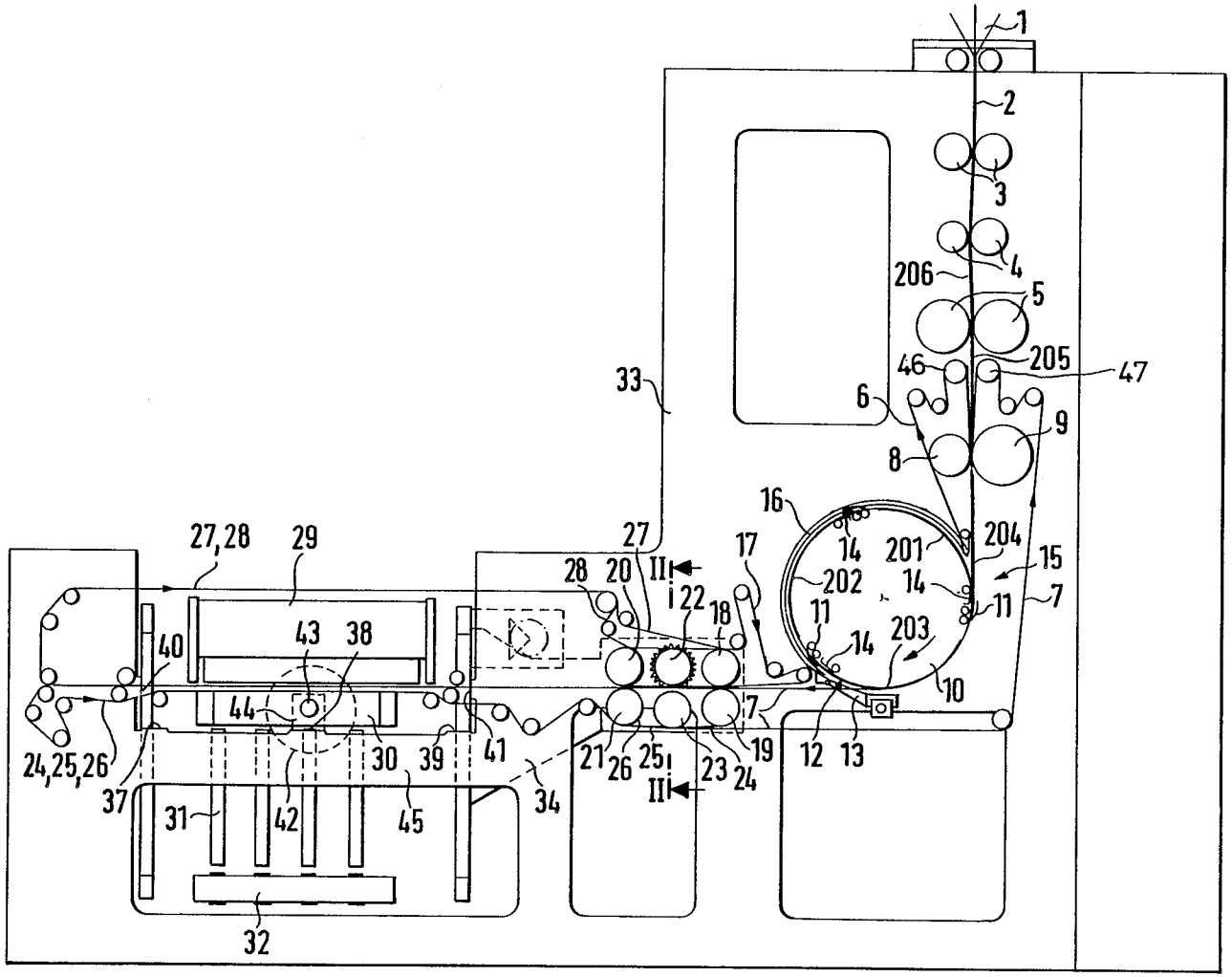
FIG. 1 is a schematic side view of the apparatus.

A paper web 2, for example derived from a rotary printing machine, is guided over a folder former, or folding triangle 1. If desired, the then folded sheets can be severed along the fold line to form two or more superposed cut webs. More than one web 2 may be folded simultaneously, so that the web 2 being pulled down from the former 1 by pulling roller pairs 3, 4 can be in the form of multi-ply webs. These webs, pulled by pulling rollers 3, 4, are delivered as web groups 206 to a cutter blade cylinder pair 5 which cuts the webs into a plurality of cut portions 201–205. The cut sheets, shown at 205 in FIG. 1, are accelerated in an accelerating transport device formed by two opposite and cooperating belt transport systems 6, 7. The belt transport systems 6, 7 are guided or looped over the customary deflection and guide rollers, shown only schematically and not further identified in the drawings, since they can be of standard and well known construction. Belt drive rollers 46, 47 and tear rollers 8, 9 form part of the belt drive system. The belt drive system accelerates the cut sheet portions 201 to 205 to the circumferential speed of a subsequent combination transfer-and-collection cylinder 10. The belt systems 6, 7 are so guided that the belts feed tangentially to the periphery of the cylinder 10. The belt guide system accompanies the cut portions at the left side until just in advance of the tangential point of the cylinder 10.

Cylinder 10, as shown in FIG. 1, is equipped with double-finger gripper systems 11. Three such systems are located, uniformly distributed, along the circumference of cylinder 10. Double-finger gripper systems are well known in the paper handling field, and, therefore, are not shown in detail or specifically described. The literature reference: A. Braun, "Atlas des Zeitungs- und Illustrations-druckes" ("Atlas of Newspaper and Magazine Printing"), Frankfurt/Main (Fed. Rep. Germany), 1960, pp. 86/87, describes such gripper systems.

The double-finger grippers 11 have a longer and a shorter gripper finger; the double fingers grip, by means of of the shorter gripper fingers, a portion 201, 202, 203 at the leading edge and guide the respective sheet or assembly of sheets about the transfer and collection cylinder 10 to a transfer position 12. The cylinder 10, in dependence on the number of the eventually superimposed sheets, can rotate several times; at each revolution, the longer fingers of the double gripper system 11 can accept a further sheet or sheet assembly, for example sheet assembly 204, 205, in order to assemble, in superposed position, a plurality of layers, for example layers 201, 204; 202, 205, 203 . . . , for then common transfer to the delivery position 12.

Blocking fingers 13 are located at the transfer position 12 above the belt transport system 7, axially shifted with respect to the belts of the belt transport system. The blocking fingers 13 block a paper path at the transfer position 12 when the cylinder 10 operates in a collection or assembly mode, that is, when it rotates about several revolutions to pick up superposed sheets or groups of sheets; the blocking fingers release the block and permit delivery at the delivery position, in cadence, when the collection operation of the collection cylinder is terminated and the requisite number of superposed sheets has been assembled on the collection cylinder.

During collection, the respective sheets or groups of sheets are guided between the reception position 15 and the delivery position 12 about the collection cylinder by the belts of the belt transport system 7 for tangential movement to and on the collection cylinder; they are then guided about the collection cylinder by guide fingers or guide vanes 16, spaced from the circumference of the collection cylinder 10 by a small distance.

In accordance with a feature of the invention, release fingers 14 are located on the transfer and collection cylinder 10, close to the positions of the dual-finger gripper systems. Such release finger systems 14 by and themselves are known, and are used to push the sheets, collected and held on the cylinder, off it when delivery is to be effected. One form of such release or push-off fingers is described, for example, in German Patent No. 31 24 639; other types may be used, as well known in the paper handling art. The release or push-off fingers are located behind, with respect to the direction of rotation of cylinder 10, the double-finger grippers 11, and axially offset with respect thereto. When in quiescent or circumferential position, they are located beneath the leading edge of the products on the cylinder 10. When sheets on the cylinder 10 are to be delivered at the delivery region 12, the double-finger grippers will open, and the push-out or release fingers 14 will deflect away from the periphery of the collection cylinder 10 to form run-out or run-off ramps for the folded products on the cylinder. Opening and closing of the grippers of the gripper systems 11, and movement of the delivery or push-off fingers 14, can be readily controlled, as well known, by roller levers which run off control cams.

Operating mechanisms of this type are well known in the paper handling and folding apparatus industry, and therefore are not shown or described in detail in the schematic representation herein. Any suitable structure to move the fingers of the grippers of the system 11, and similar structures to move the fingers of the push-off or release system 14 may be used.

The belt system 7 is carried tightly around the cylinder 10 between the reception position 15 and the delivery position 12, and thus holds all the sheets or multiple sheets in engagement with the cylinder 10. The sheets or multiple sheets, of course, are gripped by the grippers 11. The collected, superposed sheets are then pressed outwardly by the release fingers 14 when the grippers 11 open and placed on the belts of the system 7, provided the blocking finger 13 has moved to unblocking position. A further belt system 17 is guided to the belt system 7 at the delivery position 12. System 7, in combination with system 17, then feeds or transports the superposed sheets from the delivery position 12 for further handling. The sheets are tightly held between the belts of the belt systems 7 and 17.

Figure 2:
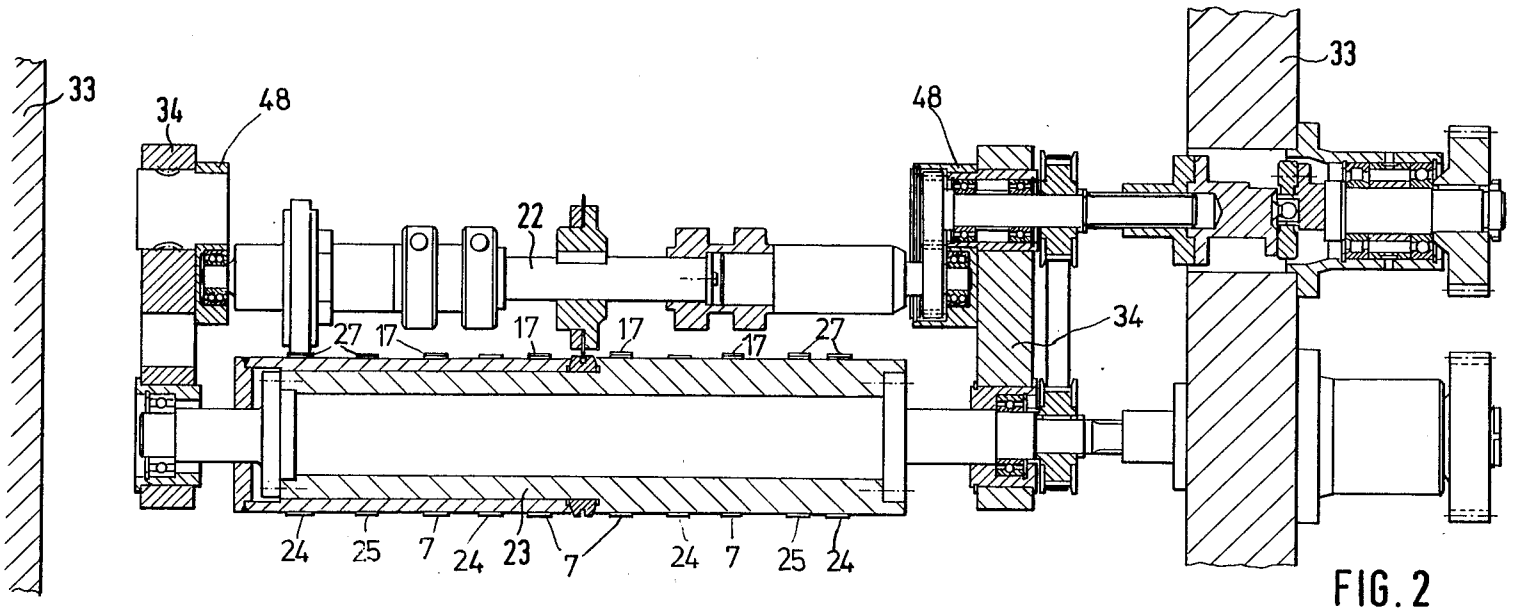
FIG. 2 is a schematic cross-sectional view along line II—II and illustrating details of the perforating roller-groove combination.

The belt systems 7 and 17 are looped between pairs of belt guide and drive rollers 18, 19, 20, 21. In accordance with a feature of the invention, a further roller pair 22, 23 is located between the roller pairs 20, 21 and 18, 19, respectively. The upper roller 22 is constructed as a perforating blade roller; the lower roller 23 is formed with a perforating groove ring, as best seen in FIG. 2. The perforating teeth of the perforating blade engage in the groove of the groove ring. The lower roller 23 additionally is used to guide the belts, as seen in FIG. 2.

The belts of the belt system 7 are guided about roller 21 downwardly and then back via a plurality of deflection and tensioning rollers to the beginning or start point of the acceleration portion in the vicinity of the drive roller 47. The belts of the system 17 are guided, downstream of the roller 20, in an upward direction and then over a plurality of deflection and tensioning rollers back to the delivery position 12. The folded products are transported through the rollers 22, 23, which effect the perforation, and from then on to a second longitudinal fold apparatus by further transport belt systems. The folded products, at the bottom side, are supported by three belt transport systems 24, 25, 26, on which the one, system 24, is looped at the right side about the roller 19, the second system 25 about the roller 23, and the third system 26 about the roller 21. Apart from this staggered start, the belt systems 24, 25, 26 run in parallel in their remaining paths to deflection and tensioning rollers downstream of the second longitudinal folding apparatus.

Further belt transport systems 27 are located at the upper side; system 27 is guided from the right about roller 18, the belts of a further system 28 are guided from the right about roller 20. Both systems 27, 28, otherwise, operate in parallel down to the deflection and tensioning rollers between the second longitudinal folding apparatus.

The folded products, thus, are flattened and stretched and transported by the belt systems 7, 24 and 23 at the bottom as well as by the systems 17 and 27 on the upper side, while being perforated by the perforating blade roller 22 engaging against the perforating groove roller 23. The belt systems 24, 25, 26 and 27, 28 then transport the folded products to the second longitudinal folding apparatus. The perforation which is effected by the perforating rollers 22, 23 will be at the level of the subsequent longitudinal fold, the perforations assuring fixed alignment of the superposed printed products in their respective position.

The second longitudinal folding apparatus can be of any standard construction and, for example, includes a folding blade cylinder 29 operatively associated with a pair of folding rollers 30. The folding blades of the folding blade cylinder 29 presses the printed products received therebeneath between the rollers 30, and the so folded products are fed to a paddle wheel 31 to be then delivered on a delivery transport belt system 32.

In accordance with a feature of the invention, an auxiliary frame 34 is provided on which the second longitudinal folding apparatus, that is, the blade cylinder 29 and the folding roller pair 30, as well as the belt systems and drive rollers 18, 19, 20, 21 therefor, and the perforating blade and perforating groove rollers 22, 23 are retained. The pull-down roller pairs 3, 4, the cutter cylinder pair 5, and the collection and transfer cylinder 10 are secured in side walls 33 of the main frame of the machine. The auxiliary frame 34 is movably located on or in the main frame, and so positioned that it can be shifted perpendicularly to the second longitudinal fold. The auxiliary frame 34 is located on suitable horizontal guides 37, 38, 39, and positioned by laterally placed vertical guides 40, 41. A spindle 43, journalled in a bearing block 44, can be operated by a hand wheel 42. The bearing block is coupled by a frame member 45 to the side wall 33 of the main frame of the machine. By rotating the spindle, the belt system and the drive rollers as well as the second folding apparatus can be shifted; the position of the perforations, as determined by the perforation blade and groove of the roller pair 22, 23, thus once set with respect to the second folding apparatus 29, 30, will not change even though the folding position with respect to the cylinder 10 may change.

The lateral shift of the auxiliary frame 34, rather than using a hand wheel, can be carried out by machinery, for example by a gear motor, or by other equivalent shifting elements, for example hydraulically or pneumatically operated piston-cylinder combinations.

Arranging the longitudinal perforating apparatus as well as the second longitudinal folding apparatus on a single support frame, namely the auxiliary frame 34, has the substantial advantage that both apparatus sub-units can be synchronously moved while the machine is in operation, so that the second fold can be adjusted, or re-adjusted to the center or, if required, to an off-center fold line of the products which are delivered to the cylinder 10 from the folding former 1 (FIG. 1).

In accordance with a preferred feature of the invention, the perforating roller 22 and the cooperating roller 23, as well as the remaining belt guide and drive rollers 18, 19, 20, 21, are so arranged that the relative spacing of opposed rollers can be changed to permit adjustment of the system to accomodate different thicknesses of folded products. For example, the perforating blade roller 22 as well as the upper guide and drive roller 18, 20 are located in adjustable eccentric bearing blocks 48 (see FIG. 2).

Figure 3:
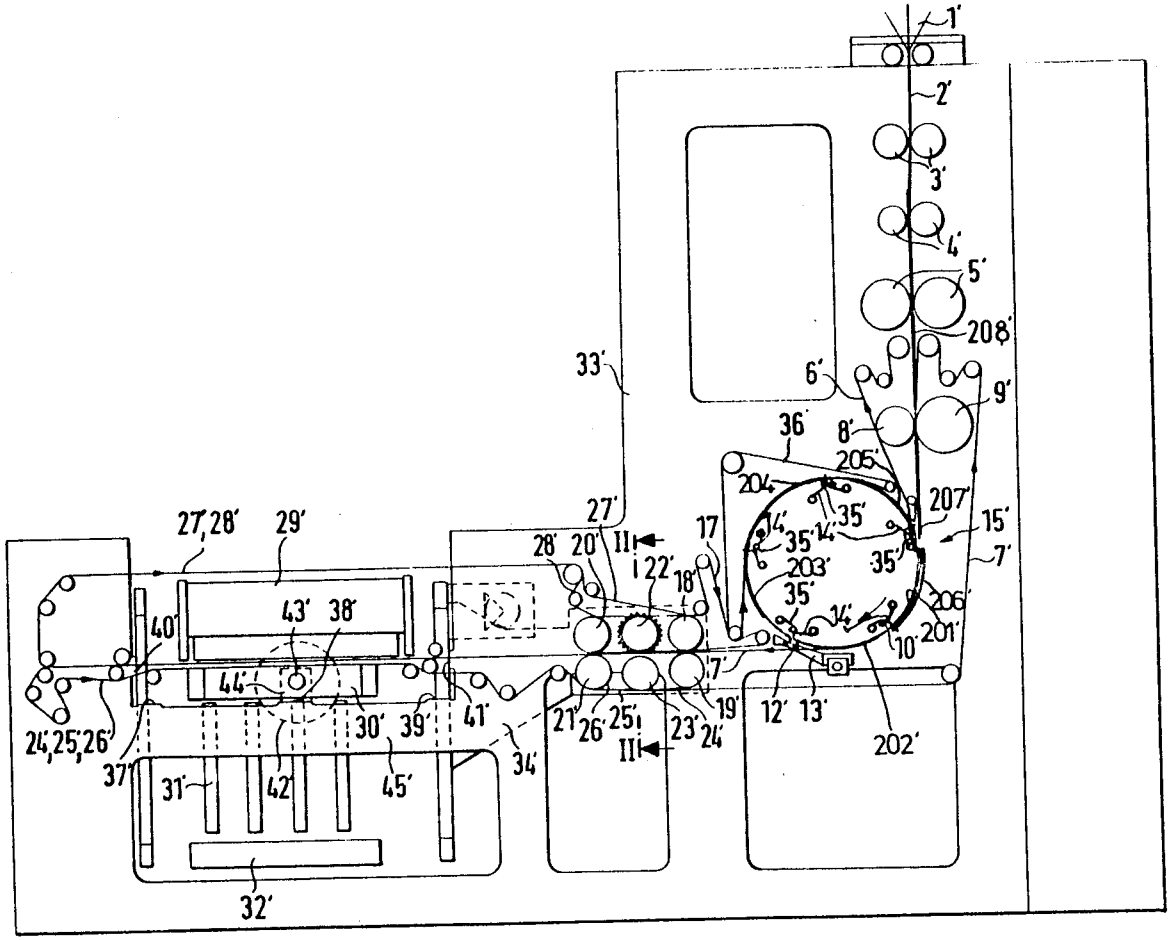
FIG. 3 is a view similar to FIG. 1, and illustrating a modified structure.

The invention has been illustrated in FIG. 1 with a transfer and collection cylinder 10 having dual-finger gripper systems 11. Rather than using grippers, puncture retention needles can be used. FIG. 3 illustrates such an arrangement. All elements similar to FIG. 1 have been given the same reference numerals, modified, however, by prime notation. The number of grippers or puncture needle systems on the cylinder 10, 10' can be variable, in dependence on the length of the format of the printed products being supplied thereto. FIG. 3 illustrates another modification which shows five puncture needle systems 35 on cylinder 10', so that respective products 201' to 208' can be handled in the system of FIG. 3. The lift-off fingers 14' are so constructed that they surround a puncture needle 35 in time form, thereby preventing skewing of printed products upon lift-off from the needles of the puncture needling systems 35. When puncture needle systems 35 are used, a second belt system 36 is preferably employed to guide the printed product in the upper half of the collection cylinder 10', when the cylinder 10' is set in the collection mode. The belt system 36 then replaces the guide sheet or vane 16 (FIG. 1).

Various changes and modifications may be made, and any features explained in connection with any one of the embodiments herein may be used with any of the others, within the scope of the inventive concept.

I claim:

1. Folding and folded products transport and handling apparatus having a first longitudinal folding apparatus (1) for providing a longitudinal fold in a sheet, or a plurality of superimposed sheets, and to furnish said folded products;

a folded product transport system (7, 8, 17);

a combination transfer and collection cylinder (10) for receiving the folded sheets from the longitudinal folding apparatus and, selectively, (a) transferring said products to the folded product transport system or (b) collecting a plurality of folded products and then transferring said products to said transport system;

a second longitudinal folding apparatus (29, 30) receiving the folded products from the transport system (7, 8, 17) and providing a second fold in said products; and means for longitudinal fixing the superimposed folded products in position relative to each other along the fold line of the second longitudinal folding apparatus, and wherein the combintion transfer and collection cylinder includes product retaining means (11, 35) positioned on said cylinder (10) for retaining said products thereon;

selectively operable lift-off means (14, 14') for lifting said products off the cylinder (10, 10') when, selectively, transfer and delivery of the folded products to the folded product transport system (7, 17) is desired;

the folded product transport system includes a belt system having transport belts (7, 17, 24, 25, 26, 27, 28) for transporting said products between said transfer and collection cylinder (10, 10') and said second longitudinal folding apparatus (29, 30), and a drive and guide roller system (18, 19, 20, 21) for said transport belts;

wherein the means for longitudinally fixing the superimposed folded products in position comprises a perforating blade roller - perforating groove roller combination (22, 23) forming part of the drive and guide roller system of said belt system, and means for relatively moving said first longitudinal folding apparatus and said second longitudinal folding apparatus (29, 30) and said belts and drive and guide roller system, including said perforating blade roller - perforating groove roller combination (22, 23) with respect to each other in a direction perpendicular to the second longitudinal fold for conjointly shifting said second longitudinal folding apparatus (29, 30) and said perforating blade roller - perforating groove roller combination, whereby perforations will be applied to said folded products while said folded products are being guided, in flat position, between said transport belts of said belt system.

2. The apparatus of claim 1, further including a frame (33) for supporting said apparatus;

and an auxiliary frame unit (34) movable with respect to said frame, said auxiliary frame unit retaining said second longitudinal folding apparatus (29, 30) and said belts and drive and guide roller system, including said perforating blade roller - perforating groove roller combination (22, 23), said auxiliary frame unit being movable in a direction perpendicular to the second longitudinal fold.

3. The apparatus of claim 1, wherein the spacing between the perforating blade roller (22) and the cooperating perforating groove roller (23) of said combination is variable and controllably adjustable to permit matching of said spacing to different thicknesses of said products.

4. The apparatus of claim 1, wherein said drive and guide rollers of said transport system include rollers located, respectively, at opposite sides of said folded products;

and wherein the spacing of said oppositely located rollers is variable and controllably adjustable to permit matching of said spacing to different thicknesses of said products.

5. The apparatus of claim 1, wherein said product retention means on the combination transfer and collection cylinder comprises at least one gripper system (11).

6. The apparatus of claim 1, wherein said product retention means (35) of said combination transfer and collection cylinder comprises at least one puncture needle system (35).

7. Folding and folded products transport and handling apparatus having a first longitudinal folding apparatus (1) for providing a longitudinal fold in a sheet, or a plurality of superimposed sheets, and to furnish said folded products;

a folded product transport system (7, 8, 17);

a combination transfer and collection cylinder (10) for receiving the folded sheets from the longitudinal folding apparatus and, selectively, (a) transferring said products to the folded product transport system or (b) collecting a plurality of folded products and then transferring said products to said transport system;

a second longitudinal folding apparatus (29, 30) receiving the folded products from the transport system (7, 8, 17) and providing a second fold in said products; and means for longitudinal fixing the superimposed folded products in position relative to each other along the fold line of the second longitudinal folding apparatus, and wherein the combination transfer and collection cylinder includes product retaining means (11, 35) positioned on said cylinder (10) for retaining said products thereon;

selectively operable lift-off means (14, 14') for lifting said products off the cylinder (10, 10') when, selectively, transfer and delivery of the folded products to the folded product transport system (7, 17) is desired;

the folded product transport system includes a belt system having transport belts (7, 17, 24, 25, 26, 27, 28) for transporting said products between said transfer and collection cylinder (10, 10') and said second longitudinal folding apparatus (29, 30), and a drive and guide roller system (18, 19, 20, 21) for said transport belts;

wherein the means for longitudinally fixing the superimposed folded products in position comprises a perforating blade roller - perforating groove roller combination (22, 23) forming part of the drive and guide roller system of said belt system, and a controlled blocking finger system (13) located between said transfer and collection cylinder (10) and said transport belt system (7, 17) to block transfer of printed products to said transport belt system when said cylinder (10) is controlled to operate, selectively, for collecting a plurality of folded products.

8. The apparatus of claim 7, further including a frame (33) for supporting said apparatus;

and an auxiliary frame unit (34) movable with respect to said frame, said auxiliary frame unit retaining said second longitudinal foleding apparatus (29, 30)

and said belts and drive and guide roller system, including said perforating blade roller - perforating groove roller combination (22, 23), said auxiliary frame unit being movable in a direction perpendicular to the second longitudinal fold for conjointly shifting said second longitudinal folding apparatus (29, 30) and said perforating blade roller - perforating groove roller combination.

9. The apparatus of claim 7, wherein the spacing between the perforating blade roller (22) and the cooperating perforating groove roller (23) of said combination is variable and controllably adjustable to permit matching of said spacing to different thicknesses of said products.

10. The apparatus of claim 7, wherein said drive and guide rollers of said transport system include rollers located, respectively, at opposite sides of said folded products;

and wherein the spacing of said oppositely located rollers is variable and controllably adjustable to permit matching of said spacing to different thicknesses of said products.

11. The apparatus of claim 7, wherein said product retention means on the combination transfer and collection cylinder comprises at least one gripper system (11).

12. The apparatus of claim 8, wherein said product retention means (35) of said combination transfer and collection cylinder comprises at least one puncture needle system (35).

* * * * *